US006990894B2

(12) United States Patent
Lininger et al.

(10) Patent No.: US 6,990,894 B2
(45) Date of Patent: Jan. 31, 2006

(54) STRAPPING MACHINE WITH SELF OPENING RE-ENTRY GATES

(75) Inventors: Joseph E. Lininger, Burlington, WI (US); Jonathan Lopez, Vernon Hills, IL (US); Timothy B. Pearson, Antioch, IL (US); Ronald W. Gurak, Oakwood Hills, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 224 days.

(21) Appl. No.: 10/439,983

(22) Filed: May 16, 2003

(65) Prior Publication Data

US 2004/0250695 A1 Dec. 16, 2004

(51) Int. Cl.
*B65B 13/04* (2006.01)

(52) U.S. Cl. ..... 100/26; 100/29; 53/589

(58) Field of Classification Search ..... 100/1–34, 100/280, 281, 283; 53/399, 589; 74/471 R, 74/469, 96; 160/117; 140/153, 154; 72/428; 226/196.1

See application file for complete search history.

(56) References Cited

U.S. PATENT DOCUMENTS 3,613,557 A 10/1971 Coleman
3,768,396 A 10/1973 Coleman
3,841,213 A 10/1974 Goodley
3,913,472 A * 10/1975 Buck ..... 100/4
4,520,720 A 6/1985 Urban et al.
4,597,324 A * 7/1986 Spilde ..... 454/364
5,311,721 A * 5/1994 Urchaga ..... 53/118
5,414,980 A 5/1995 Shibazaki et al.
6,499,525 B1 * 12/2002 Lai ..... 156/580
6,532,722 B2 3/2003 Gerhart et al.
6,543,341 B2 4/2003 Lopez
6,640,700 B2 * 11/2003 Helland et al. ..... 100/26

* cited by examiner

*Primary Examiner*—Derris H. Banks
*Assistant Examiner*—Jimmy T Nguyen
(74) *Attorney, Agent, or Firm*—Mark W. Croll, Esq.; Donald J. Breh, Esq.; Welsh & Katz, Ltd.

(57) ABSTRACT

A reentry gate assembly is for use with a strapping machine of the type having a feed assembly, a chute and a strapping head. The reentry gate assembly directs returning strapping material into the strapping head and releases the strapping material therefrom to prevent the strap from becoming caught as it is pulled from the chute. The reentry gate assembly includes a body having a strap path surface and first and second pivotable gates movable between a closed position in which the gates overly the strap path surface and define a strap pathway, and an open position in which the gates are pivoted away from the strap path surface. A link operably connects the first and second gates. When strapping material present in the strap pathway with the gates closed is urged outwardly of the strap pathway, contact of the strapping material with either the first or second gate moves the link to open the other of the first or second gate, so that both gates open together. The assembly is operably connected to the strapping head such that opening of the strapping head opens the reentry gate assembly to assure release of the strapping material.

19 Claims, 3 Drawing Sheets

STRAPPING MACHINE WITH SELF OPENING RE-ENTRY GATES

BACKGROUND OF THE INVENTION

The present invention is directed to an improved re-entry gate arrangement for a strapping machine. More particularly, the present invention is directed to a re-entry gate assembly for a strapping machine in which a pair of linked gates both open upon the urging open of either gate.

Strapping machines are used for securing straps around loads. One type of known strapper includes a strapping head and drive mechanism mounted within a frame. Strapping material is fed, for a supply (e.g., a dispenser) into the chute. A typical drive mechanism includes feed wheels that "push" the material through the chute via the strapping head. The leading end of the strapping material traverses the chute and re-enters the strapping head at the end of the chute.

The strap is then rewound and tensioned around the load, the overlying strap courses welded together and the trailing end of the strapping material severed or cut from the supply. During the rewinding and tensioning step, the strap is "pulled" from the chute. During the "pulling", the force of the exiting strap opens one or more doors, gates or latches that facilitate removing the strap from the chute.

The point along the chute at which the strap exits the chute and re-enters the strapping head is at the re-entry gate assembly. A typical re-entry gate assembly includes opposing doors or gates that are independently urged open to permit the strap to pass from the chute. The gates must have sufficient resistance to stay closed to maintain the strap within the chute, but must also open as the strap exerts sufficient force (e.g., when pulled during re-winding), to the release the strap from the chute.

It has been found that, at times, strap does not release evenly across the face of the gates. In the event that the strap contacts one of the doors prior to, or with greater force than it contacts the other door, the strap can become caught on the gates and at the strapping head, thus causing machine malfunction. It has also been found that, due to the geometry of the cute, and gates, the frame and the load, the strap may not fully strip from the chute during tensioning. As such, again, the strap can become caught on the strapping head causing a machine malfunction.

Accordingly, there exists a need for a re-entry gate assembly for a strapping machine that permits ready re-entry of the strapping material into the strapping head, following traversal through the strap chute. Desirably, such a re-entry gate assembly prevents the strap from becoming caught at the chute and/or strapping head, during tensioning modes (as the strap is pulled from the chute). Most desirably, such a reentry gate assembly urges both gates open with the opening (pivoting) of the strapping head to assure release of the strapping material.

BRIEF SUMMARY OF THE INVENTION

A reentry gate assembly for a strapping machine permits ready re-entry of the strapping material into the strapping head, following traversal through the strap chute. Such a re-entry gate assembly prevents the strap from becoming caught as the strap exits the chute during tensioning mode (as the strap is pulled from the chute), and following opening of the strapping head, and thus prevents the strap from becoming caught as it exits the gate.

An exemplary strapping machine is of the type having a feed assembly, a chute and a strapping head. The strapping machine is configured to convey a strapping material into the strapping head, into and around the chute and to exit the chute and return to the strapping head. The strapping head is configured to receive first and second courses of associated strapping material, position, tension and seal the strapping material around a load.

The reentry gate assembly is positioned adjacent the strapping head in an opening in the chute. The reentry gate is configured to receive the strap as it return around the chute, introduce the strap back into the strapping head, and release the strap from the chute as the strap is tensioned or pulled to the load.

The reentry gate assembly includes a body having a strap path surface and first and second pivotable gates movable between a closed position in which the gates overly the strap path surface and define a strap pathway, and an open position in which the gates are pivoted away from the strap path surface. A link operably connects the first and second gates so that when strapping material present in the strap pathway with the gates closed is urged outwardly of the strap pathway, contact of the strapping material with either the first or second gate moves the link to open the other gate. In this manner, the gates open together with the opening of either gate.

In a preferred embodiment, the gates are biased to the closed position. A biasing element such as a spring can be disposed between each gate and the body to bias the gates to the closed position.

To facilitate connection of the gates, each gate includes a leaf portion overlying the strap path and a foot portion depending from the leaf portion. Each gate further includes a pivot disposed between the leaf portion and foot portion about which the gate pivots. Each foot portion extends toward the other foot portion and defines a link arm. The link operably connecting the gates extends between the link arms. Preferably, the link arms are on planes different from one another relative to the strap path surface and the link extends at an angle between the link arms.

A strapping machine having a frame, a chute, a strapping head and a reentry gate assembly is also disclosed. The reentry gate assembly includes a strapping head contact member or lever that, in cooperation with the strapping head, opens both gates upon opening (or pivoting open) of the strapping head.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
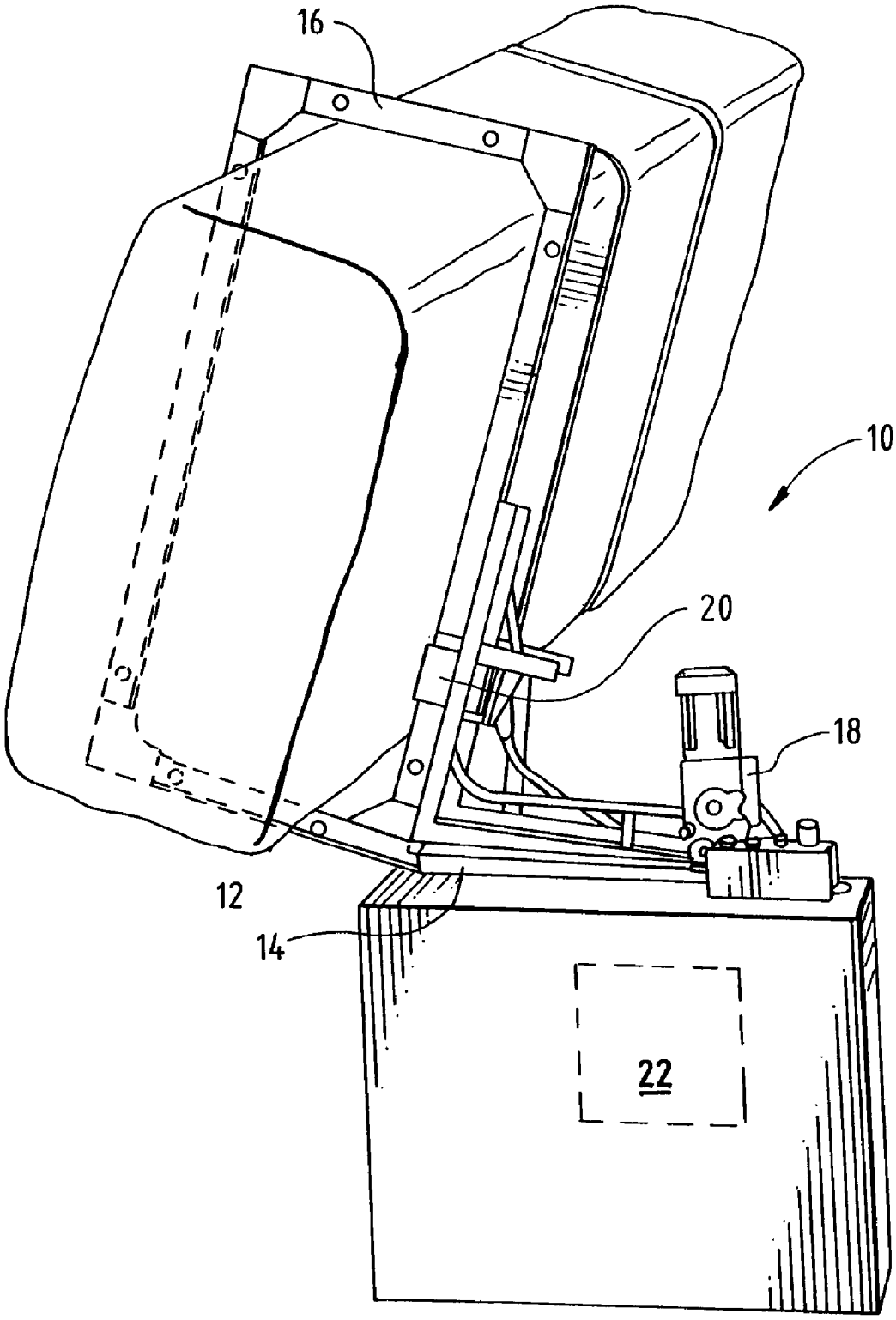
FIG. 1 is a perspective view of an exemplary strapping machine having a self opening re-entry gate assembly embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a self opening re-entry gate assembly 12 embodying the principles of the present invention. The strapping machine 10 includes, generally, a frame 14, a strap chute 16, a feed assembly 18 and a strapping head or weld head 20. A controller 22 provides automatic operation and control of the strapper 10.

In operation, strap material is fed from a supply, such as a spool or dispenser (not shown). The strap is fed to (or pulled by) the feed assembly 18, and is fed into and through the strapping head 20 into the chute 16. The strap traverses around the chute 16 and re-enters the strapping head 20 at the re-entry gate assembly 12. As set forth above, the re-entry gate assembly 12 is positioned at the end of the chute 16 and as such, re-feeds the strapping material into the strapping head 20.

The strap end that re-enters the strapping head 20 (which end is referred to as the leading end of the strap) then moves into the strapping head. Once inside of the strapping head 20, the leading end is gripped at a gripper and the trailing end is pulled or tensioned around the load. The tensioning action strips the strap from the chute 16 and positions the strap around the load L. The overlying courses of strapping material (inside the strapping head) are welded and the trailing end is cut to free the load L. The strapping head 20 anvil 21 (via pivoting movement of the strapping head side plate 23), then pivots out of the strap path and the strap is released from the strapping head 20. Exemplary strapping heads are disclosed in Gerhart, U.S. Pat. No. 6,532,722 and Lopez, U.S. Pat. No. 6,543,341, both of which patents are commonly assigned with the present application and both of which are incorporated herein by reference.

The present re-entry assembly 12 serves a number of functions. First, it provides a re-entry point for the strapping material from the chute 16, back into the strapping head 20. As such it serves to direct the strap exiting the chute 16 into the strapping head 20. In addition, the gate assembly 12 serves as the last point of contact of the strap as it is stripped or pulled from the chute 16. That is, the strap is retained within the chute 16 by various guides and/or walls as the strap is conveyed through the chute 16. These guides and/or walls are moved away from a strap supporting position (e.g., the guides/walls are pulled out from under the strap) as the strap is tensioned. This results in the strap being stripped from the chute 16 and positioned on or around the load L.

The re-entry gate 12 is the last position along the strap path (and is immediately adjacent the chute 16 end) from which the strap is stripped. To this end, it has been found that it is highly desirable for the strap to pull evenly from the gate 12. That is, the plane of the strap should be perpendicular to the direction of movement of the strap toward the load (e.g., the strap should not skew as it is stripped from the chute 16). It has also been found that for certain loads and strapping conditions, the strap may not fully strip from the chute 16 (and from the reentry gate assembly) following tensioning and welding. To this end, problems have been encountered with the strap becoming hung-up or caught at the reentry gates after the strapping cycle has been completed.

The present re-entry gate assembly 12 includes first and second gates 24, 26, respectively, that are linked to one another so that as either of the gates 24 or 26 is pulled or otherwise urged open, the other gate 26 or 24 opens. The reentry 12 includes a wedge-shaped body 28 having a surface 30 (the reentry surface) along which the strap traverses. The first and second gates 24, 26 are hingedly mounted to the body 28 to define an elongated, openable track, as indicated at 32, through which the strap traverses. The strap enters the reentry 12 in the direction indicated by the arrow at 34.

The gates 24, 26 are mounted so as to pivot open (as indicated by the arrows at 36) transverse to a plane $P_{30}$ defined by the strap path (e.g., generally transverse to a plane defined by the reentry surface). The gates 24, 26 each pivot about a pivot pin 38 that extends through openings 40 in the body 28 that lie on either side of the gate hinge 42. In this arrangement, the gates 24, 26 pivot about axes $A_{24}$, $A_{26}$ that are substantially parallel to the plane $P_{30}$ of the reentry surface 30.

Figure 3:
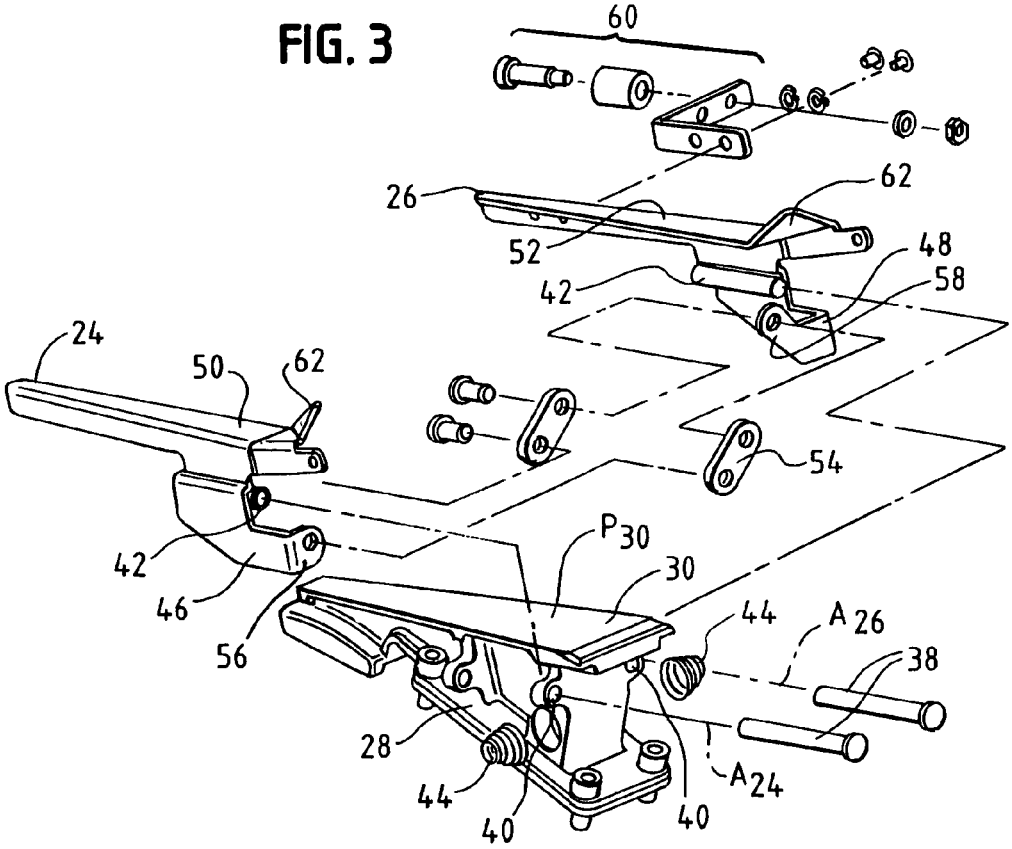
FIG. 3 is an exploded view of the re-entry gate assembly.
Figure 4:
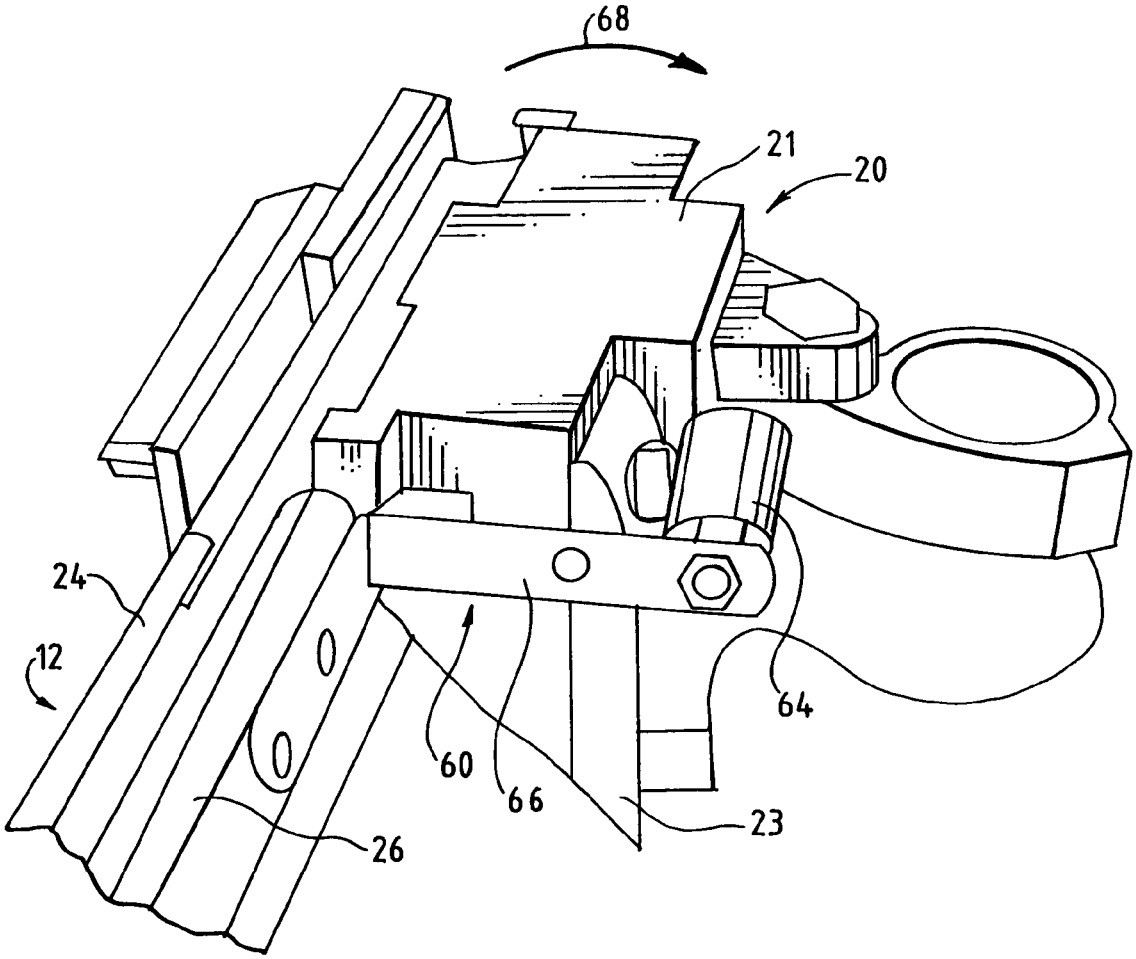
FIG. 4 is a perspective illustration of the reentry gate mounted to the strapping head for cooperating movement, to open the gates upon opening of the strapping head.

The gates 24, 26 are biased to the closed position (that is, overlying the reentry surface 30) to define the strap path 32. In a present embodiment, a spring 44 is positioned between the body 28 the respective gates 24, 26, at a lower or foot region 46, 48, respectively, of the gate 24, 26 opposite of the gate leaf 50, 52, respectively, relative to the respective gate hinges 42. As seen in FIG. 3, the springs 44 urge the lower portions 46, 48 of the gates 24, 26 outwardly which in turn urges the gates 24, 26 to the closed position, thus maintaining the gates 24, 26 closed during normal operation, until the strap is stripped from the chute 16.

Figure 2:
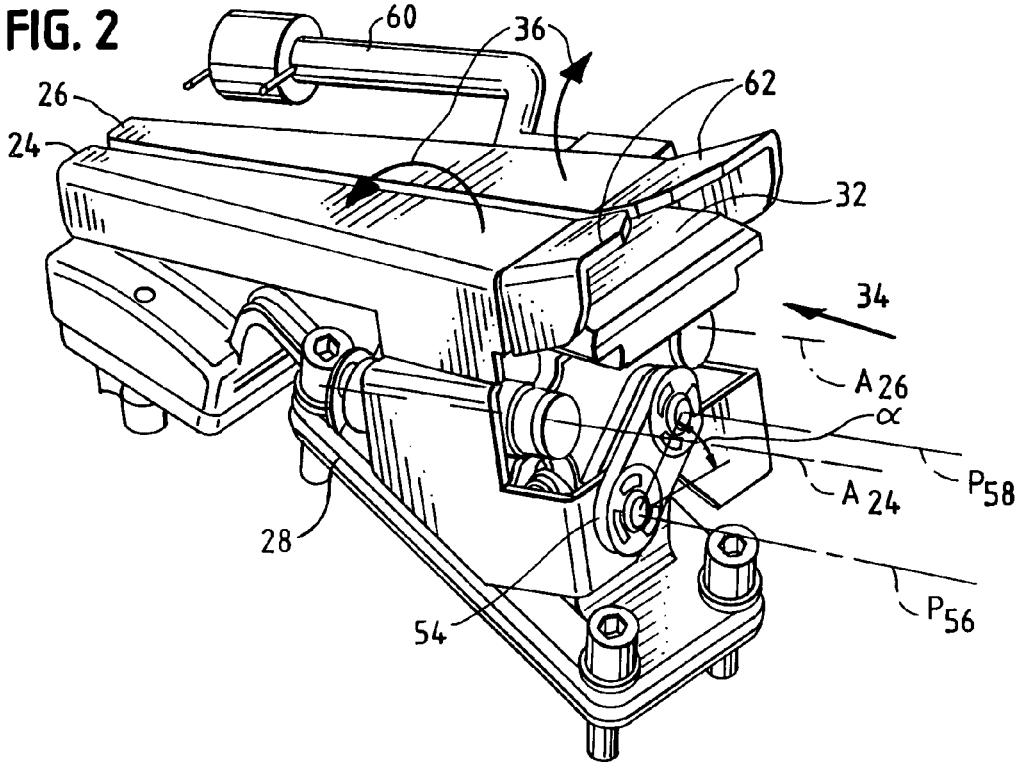
FIG. 2 is a perspective view the self opening re-entry gate assembly as viewed looking along the strap path, toward the weld head.

The gates 24, 26 are operably connected to one another by a link 54. The link 54 is connected to the respective gates 24, 26 at gate link arms 56, 58, respectively. The gate link arms 56, 58 are inwardly oriented extensions formed from their respective gates 24, 26 at the gate foot portions 46, 48. As best seen in FIG. 2, the link arm 56 for gate 24 is located at a plane $P_{56}$ that is below the pivot axis $A_{24}$ for gate 24, whereas the link arm 58 for gate 26 is located at a plane $P_{58}$ that is above the pivot axis $A_{26}$ for gate 26. In such an arrangement, the link 54 is positioned at an angle $\alpha$ as it extends between the arms links 56, 58. To this end, the urging of either arm 56 or 58 results in a pushing motion or force (e.g., opening of gate 24 pushes gate 26 open) or in a pulling motion or force (e.g., opening of gate 26 pulls gate 24 open) through an arcuate paths.

Gate 26 also includes a release member or lever 60 extending from a side thereof. The lever 60 includes a roller 64 mounted to an arm 66 extending from gate 26. The lever 60 is configured to cooperate with the strapping head 20 to open the gates 24, 26 when the strapping head 20 opens (pivots) to release the strap. To this end, as the strapping head 20 pivots open (that is, as the anvil 21 pivots open by movement of the head side plate 23, as indicated by the arrow at 68), the side plate 23 contacts the lever roller 64 which urges the gates 24, 26 open. Thus, the strap is readily released from the gate assembly 12, even if it did not release from the assembly 12 during tensioning. In addition, the lever 60 permits manually opening the gates 24, 26 (by urging gate 26 open) to, for example, clear any debris or clogs from the reentry. The gates 24, 26 can also include upturned entrances 62 that define slightly enlarged openings at the entry to the reentry assembly gates 24, 26. This facilitates introduction of the strap into the reentry assembly 12.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A reentry gate assembly for a strapping machine of the type having a feed assembly, a chute and a strapping head, the strapping machine configured to convey a strapping material into the strapping head, into and around the chute and to exit the chute and return to the strapping head, the strapping machine configured to receive first and second courses of associated strapping material, position, tension and seal the strapping material around a load, the reentry gate assembly comprising:

a body having a strap path surface;

first and second pivotable gates movable between a closed position in which the gates overlie the strap path surface and define a strap pathway, and an open position in which the gates are pivoted away from the strap path surface, the gates being biased to the closed position by a biasing element disposed between each gate and the body; and a link operably connecting the first and second gates, wherein when strapping material present in the strap pathway with the gates closed is urged outwardly of the strap pathway, contact of the strapping material with either the first or second gate moves the link to open the other of the first or second gate.

2. The reentry gate assembly in accordance with claim 1 wherein the gates each have an upturned entrance.

3. The reentry gate assembly in accordance with claim 1 wherein the gates each pivot about an axis that is generally parallel to a plane defined by the strap path surface.

4. A reentry gate assembly in for a strapping machine of the type having a feed assembly, a chute and a strapping head, the strapping machine configured to convey a strapping material into the strapping head, into and around the chute and to exit the chute and return to the strapping head, the strapping machine configured to receive first and second courses of associated strapping material, position, tension and seal the strapping material around a load, the reentry gate assembly comprising:

a body having a strap path surface;

first and second pivotable gates movable between a closed position in which the gates overlie the strap path surface and define a strap pathway, and an open position in which the gates are pivoted away from the strap path surface; and a link operably connecting the first and second gates, wherein when strapping material present in the strap pathway with the gates closed is urged outwardly of the strap pathway, contact of the strapping material with either the first or second gate moves the link to open the other of the first or second gate, and wherein each gate includes a leaf portion overlying the strap path and a foot portion depending from the leaf portion, each gate further including a pivot disposed between the leaf portion and foot portion about which the gate pivots, each foot portion extending toward the other foot portion and defining a link arm, wherein the link extends between the link arms.

5. The reentry gate assembly in accordance with claim 4 wherein the link arms are on planes different from one another relative to the strap path surface.

6. The reentry gate assembly in accordance with claim 5 wherein the link extends at an angle between the link arms.

7. A reentry gate assembly for a strapping machine of the type having a feed assembly, a chute and a strapping head, the strapping machine configured to convey a strapping material into the strapping head, into and around the chute and to exit the chute and return to the strapping head, the strapping machine configured to receive first and second courses of associated strapping material, position, tension and seal the strapping material around a load, the reentry gate assembly comprising:

a body having a strap path surface and opposing pivotable gates, each gate movable about a respective axis between a closed position in which the gates overlie the strap path surface to a strap pathway, and an open position in which the gates are pivoted away from the strap path surface, the gates being operably connected such that opening one of the gates opens the other gate, the assembly including a contact member mounted to one of the gates and engageable with the strapping head, such that opening of the strapping head opens the gates.

8. The reentry gate assembly in accordance with claim 7 wherein the gates are operably connected to one another by a mechanical link.

9. The reentry gate assembly in accordance with claim 8 wherein the gates each include a link arm rotatable about the respective gate pivot axis, and wherein the mechanical link connects the respective link arms to move through arcuate planes.

10. A strapping machine for positioning a strapping material around an associated load, tensioning and sealing the strapping material to itself around the load, comprising:

a frame;

a chute defining a strap path and having an opening therein, the chute being mounted to the frame;

a strapping head mounted to the frame and configured for receipt in the chute opening, the strapping head configured to receive a free end of the strapping material and to seal the strapping material to itself; and a reentry gate assembly disposed adjacent the strapping head and within the chute opening and providing a reentry path for strapping material following conveyance through the chute and return to the strapping head, the reentry gate assembly having a body having a strap path surface, first and second pivotable gates movable between a closed position in which the gates overly the strap path surface and define a strap pathway, and an open position in which the gates are pivoted away from the strap path surface, and a link operably connecting the first and second gates, wherein when strapping material present in the strap pathway with the gates closed is urged outwardly of the strap pathway, contact of the strapping material with either the first or second gate moves the link to open the other of the first or second gate.

11. The strapping machine in accordance with claim 10 wherein the gates are biased to the closed position.

12. The strapping machine in accordance with claim 11 including a biasing element disposed between each gate and the body to bias the gates to the closed position.

13. The strapping machine in accordance with claim 10 wherein each gate includes a leaf portion overlying the strap path and a foot portion depending from the leaf portion, each gate further including a pivot disposed between the leaf portion and foot portion about which the gate pivots, each foot portion extending toward the other foot portion and defining a link arm, wherein the link extends between the link arms.

14. The strapping machine in accordance with claim 13 wherein the link arms are on planes different from one another relative to the strap path surface.

15. The strapping machine in accordance with claim 14 wherein the link extends at an angle between the link arms.

16. The strapping machine in accordance with claim 10 wherein the gates each have an upturned entrance.

17. The strapping machine in accordance with claim 10 wherein the gates each pivot about an axis that is generally parallel to a plane defined by the strap path surface.

18. The strapping machine in accordance with claim 10 wherein the strapping head opens to release the strap therefrom, and wherein a contact member operably connects the gates to the strapping head such that opening of the strapping head opens the gates.

19. The strapping machine in accordance with claim 18 wherein the contact member includes a roller mounted to one of the gates for contact with the strapping head.

* * * * *